US005970636A

United States Patent [19]

Briscoe et al.

[11] Patent Number: 5,970,636

[45] Date of Patent: Oct. 26, 1999

[54] DUMP BLOCK

[75] Inventors: Terry L. Briscoe; John S. Kreitzberg, both of Portland, Oreg.

[73] Assignee: Esco Corporation, Portland, Oreg.

[21] Appl. No.: 08/900,352

[22] Filed: Jul. 25, 1997

[51] Int. Cl.[6] ..... E02F 3/48; E02F 3/58; E02F 3/60; B61C 3/00

[52] U.S. Cl. ..... 37/396; 37/395; 37/397; 37/398; 37/399; 37/401; 294/68.27

[58] Field of Search ..... 37/395, 396, 397, 37/398, 399, 401; 294/68.27; 411/400

[56] References Cited

U.S. PATENT DOCUMENTS

| | | | |
|---|---|---|---|
| 1,695,480 | 12/1928 | Buoy | 37/396 |
| 2,024,557 | 12/1935 | White | 37/396 |
| 2,168,643 | 8/1939 | Berner | 37/396 |
| 2,629,190 | 2/1953 | Berner | 37/396 |
| 2,633,649 | 4/1953 | Page | 37/396 |
| 3,014,683 | 12/1961 | Littmann | 411/400 X |
| 3,597,865 | 8/1971 | Rumfelt | 37/396 |
| 4,074,519 | 2/1978 | Barrett | 411/400 X |
| 4,740,023 | 4/1988 | Miller | 411/400 X |
| 4,958,796 | 9/1990 | Bermosky | 411/400 X |
| 5,307,571 | 5/1994 | Behlendorf et al. | 37/396 |
| 5,321,902 | 6/1994 | Gregory | 37/397 |
| 5,636,460 | 6/1997 | Dretzka | 37/397 |

FOREIGN PATENT DOCUMENTS

| | | | |
|---|---|---|---|
| 983204 | 12/1982 | U.S.S.R. | 37/399 |
| 1364661 | 1/1988 | U.S.S.R. | 37/396 |

*Primary Examiner*—Thomas B. Will
*Assistant Examiner*—Gary S. Hartmann
*Attorney, Agent, or Firm*—Banner & Witcoff, Ltd.

[57] ABSTRACT

An integral dump block for use in a dragline bucket that comprises a sheave to movably support a dump line, a central pin rotatably supporting the sheave, and a housing to couple the pin to lift lines. Bearings are disposed within the sheave and each side of the housing for receiving the pin for free rotation. Hoist lines for supporting a dragline bucket are connected to each end of the pin. In this way, moment forces in the hoisting assembly can be substantially eliminated. Further, a number of parts can be eliminated to provide a reduction in weight and height of the hoisting linkage assembly.

21 Claims, 6 Drawing Sheets

DUMP BLOCK

FIELD OF THE INVENTION

The present invention is directed to a dragline bucket assembly, and, more particularly, to a unique dump block which substantially eliminates moment forces in the hoist linkage assembly for the bucket.

BACKGROUND OF THE INVENTION

Dragline buckets are shovel-like enclosures which are advanced and controlled by flaccid lines, such as chains, cables or ropes. The buckets include an open end through which earthen material is received and accumulated as the buckets are dragged through the ground.

In a typical prior art system, a dragline bucket 2 is supported generally at a rear portion thereof by a pair of hoist lines 4 attached to the opposed side walls of the bucket. The upper ends of the hoist lines are secured to a dump block connecting link member 16 by swivel links 18. A spreader bar 5 is placed between the two hoist lines to prevent the lines from rubbing on the sides of the bucket. The upper end of link member 16 is attached to a hoist link 20 which, in turn, is connected to an equalizer 22. The equalizer is secured to the lower ends of lift lines 26 by hoist sockets 24. The lift lines are coupled to an overhead boom (not shown) for lifting and lowering the bucket. Equalizer 22 rotates relative to hoist link 20 to account for any differences which may exist in the lengths of the two lift lines.

A dump line 6 is provided to support and control the front end of bucket 2. One end of the dump line is attached by a socket 8 to a front upper edge of the bucket 2. The other end of dump line 6 is secured by a socket 13 to a drag line 7, which is typically referred to as a drag rope. The drag line 7 is connected to the front of the bucket by a pair of pull lines 9, typically referred to as drag chains, in order to pull the bucket through the ground in a digging operation.

The dump line is supported along a medial portion by a dump block 10, which is secured by a dump link 14 to an outwardly extending arm 16*a* of link member 16. Dump block 10 includes a rotatable sheave 12 about which dump line 6 is passed, and a housing 11 which is used to attach the sheave to link member 16. The tension applied to the dump line by its connection to drag line 7 is used to lift the front of the bucket and thereby prevent unwanted forward tipping of the bucket. Release of the tension in the drag line 7 permits the bucket to tip forward and the accumulated load to be dumped.

As can be appreciated, the forces encountered in a dragline bucket operation are typically very large. As an example, the forces experienced in the lift lines for a large dragline bucket can reach 500,000 pounds or more. As can be appreciated, hoist lines 4, lift lines 26, and dump line 6 via dump block 10 all transmit large forces with vertical and horizontal components to the hoist linkage assembly, and particularly to link member 16. These large and disparate forces translate into large moment forces which impose additional substantial stresses on the parts of the hoist linkage assembly. These additional stresses work to limit the usable life of the various parts. Such reductions in the usable life of these parts not only results in additional replacement costs, but also increased down time in the operation of the bucket.

Moreover, conventional hoist linkage assemblies for dragline buckets have typically included many components which collectively add a significant weight to be supported by the boom. This weight of the hoisting assembly causes a concomitant reduction in the amount of load which can be carried by the bucket because of weight limitations of the boom and other related equipment. This collection of parts in the hoisting linkage also has a significant length which limits the distance the bucket can be pulled up to the boom, and hence, the height to which the bucket can be raised.

SUMMARY OF THE INVENTION

The principles of the invention may be advantageously used to provide a dump block of an efficient and durable construction, which substantially eliminates the moment forces experienced in the components of prior art hoisting assemblies.

In accordance with the present invention, the dump block includes a sheave for supporting a dump line, a pin rotatably supporting the sheave, and a housing or other framework adapted to couple the pin to the lift lines extending downward from the boom. Opposite ends of the pin are provided with connectors to which the hoist lines extending up from the bucket are attached. The pin is set in bearings for free rotation relative to the sheave and the housing. Accordingly, the forces generated in the hoist, lift and dump lines are all directed to the central pin of the dump block. Moment forces are therefore eliminated due to the directing of all the loads in the linkage assembly to the central pin and because of the free rotation of the sheave in supporting the dump line, the free rotation of the pin in supporting the hoist lines, and the freely rotatable connection of the housing to the pin in coupling the dump block to the lift lines. As a result, less stress is experienced in the components of the inventive hoist linkage as compared to the assemblies of the prior art. Reductions in stress will then provide a longer usable life for the hoisting components and less down time for the bucket.

In addition, by attaching the hoist, lift and dump lines to the inventive dump block, a fewer number of parts are required in the hoisting assembly. For example, swivel links 18, link member 16, and hoist link 20 are no longer needed. Hence, a significant weight reduction is realized due to the elimination of these parts. Further, this reduction in weight is realized even with the use of a larger pin and sheave to increase the useable life of the dump block and dump line.

Further, the inventive hoist assembly reduces the overall length of the linkage as compared to a conventional hoisting linkage. Accordingly, the bucket can be raised closer to the boom and thus to a higher elevation with the present invention.

BRIEF DESCRIPTION OF THE DRAWINGS

Certain preferred embodiments are described in detail below with reference to the appended drawings wherein.

Figure 1A:
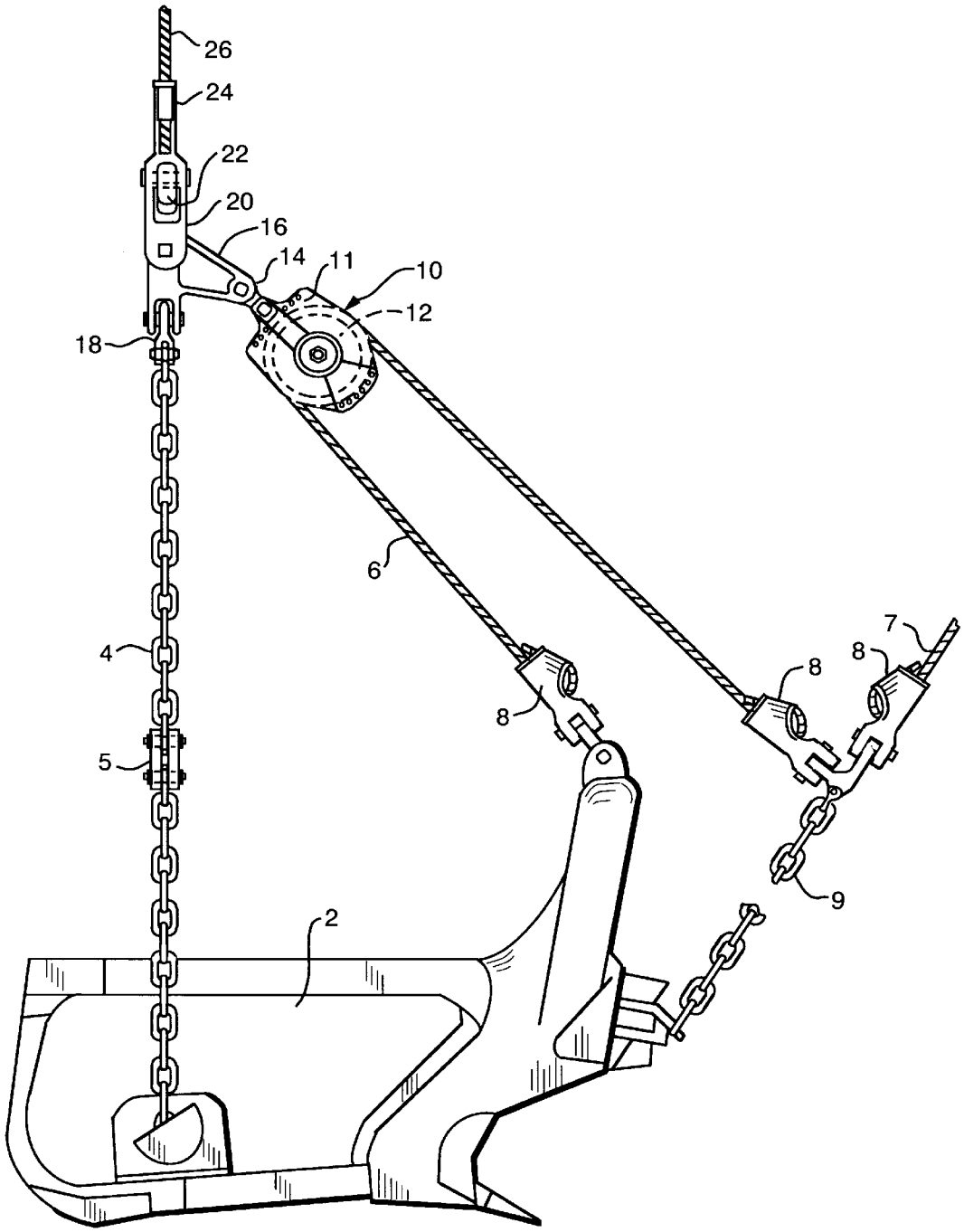
FIG. 1A (PRIOR ART)
FIG. 1A is a side elevational view of a dragline bucket of the prior art.
Figure 1B:
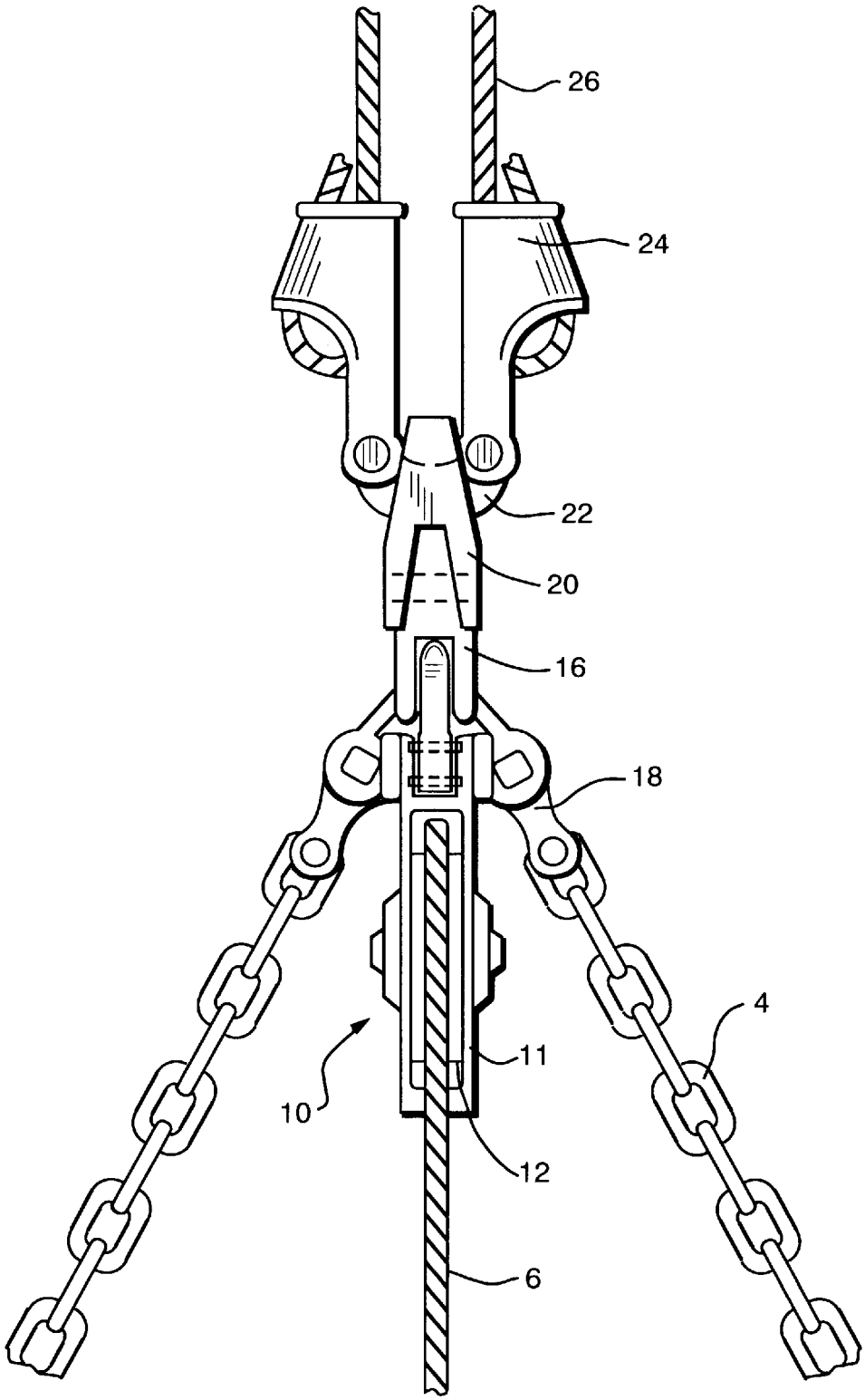
FIG. 1B (PRIOR ART)
FIG. 1B is a front elevational view of a prior art hoisting assembly for the dragline bucket of FIG. 1A.

The figures referred to above are not drawn necessarily to scale and should be understood to present a simplified representation of the invention, illustrative of the basic principles involved. The same reference numbers are used in the drawings of the present invention as those used in the drawings of the prior art device for similar or identical components.

DETAILED DESCRIPTION OF THE PREFERRED EMBODIMENTS

In accordance with the present invention, a dump block 10 forms an integral part of a hoisting linkage H which cooperates with hoist lines 4, lift line(s) 26, and a dump line 6 to lift and control the operation of a dragline bucket. In general, dump block 10 comprises a sheave 12, a central pin 28, and a housing or other framework 11.

As is conventional, dump line 6 is connected at one end to a drag line (i.e., a drag rope) and at its other end to the front end of the bucket. A medial portion of the dump line then wraps around sheave 12 in order to lift or drop the front end of the bucket in accordance with the tension in the drag line. A groove (not shown) is defined around the outer circumference of the sheave to receive the dump line. The sheave is rotatably supported by a bearing 38 for free rotation about pin 28 to ensure free movement of the dump line as needed to control the bucket.

Housing 11 extends about sheave 12 to couple pin 28 to the lift lines 26. The housing preferably encases the sheave for protection, but could also be formed as a pair of arms or other framework that extends between pin 28 and the connections for the lift lines. Although the housing is illustrated as being composed of a pair of mating parts joined by fasteners 54, the housing could be fabricated in other ways such as welding or casting. A bearing 40 is provided on pin 28, to each side of sheave 12, to rotatably couple the housing to the pin. As discussed more fully below, the bearings ensure a free rotation between the pin and the housing.

The upper end of housing 11 is provided with a connection member 30 to couple the dump block to the lift lines. In the preferred construction, the connection member is a clevis 30 that projects from an upper surface of housing 11 to connect to an equalizer 22. Equalizer 22 is connected to clevis 30 via a fastener 34 which extends through aligned apertures in clevis 30 and equalizer 22. Hoist sockets 24, secured to the ends of lift lines 26, are connected to opposed ends of equalizer 22 via fasteners 36. Equalizer 22 rotates about fastener 34 in order to compensate for differences which may exist in the lengths of the two lift lines 26.

Figure 2:
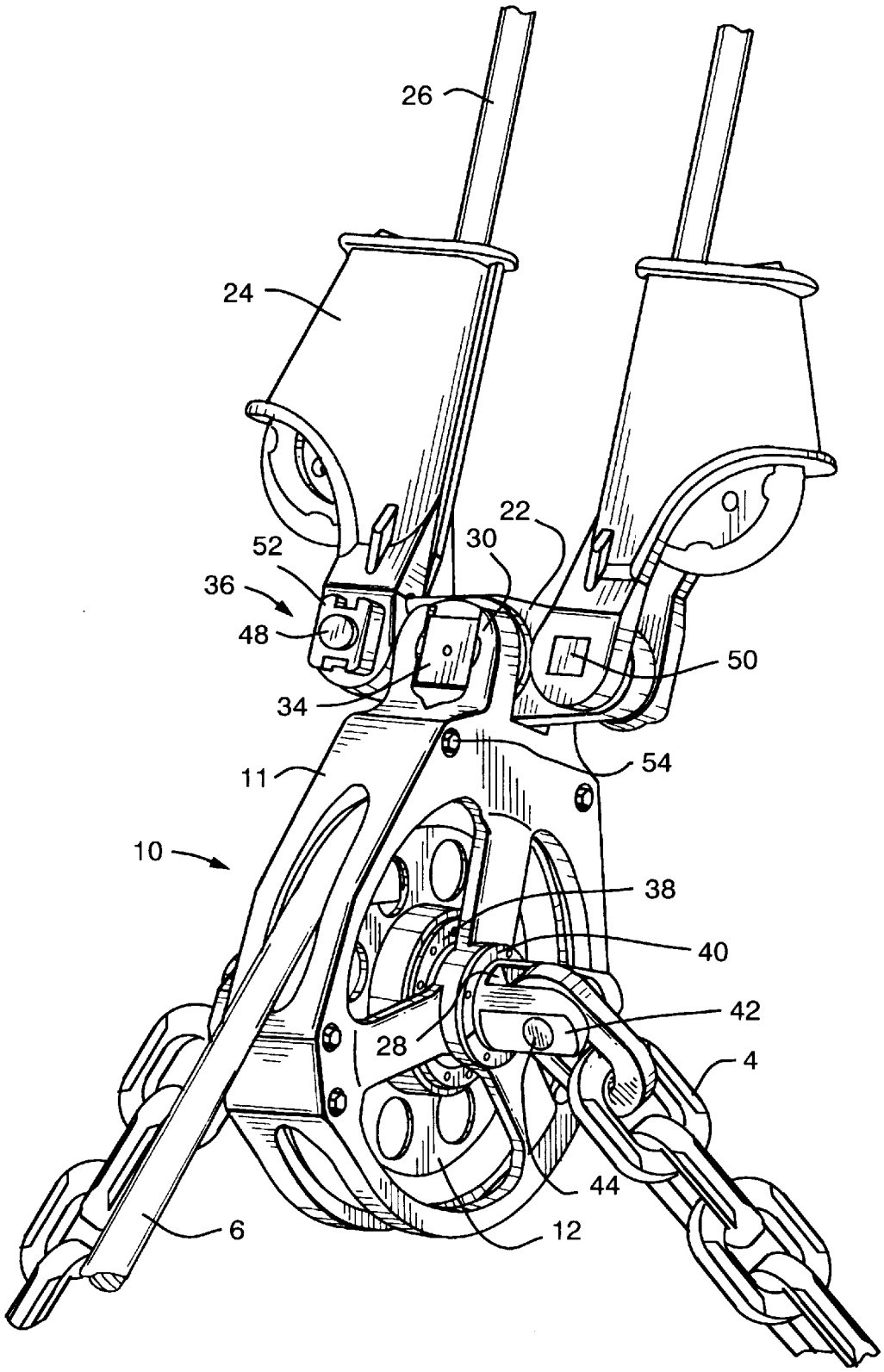
FIG. 2 is a perspective view of a dump block of the present invention in a hoisting assembly.
Figure 4:
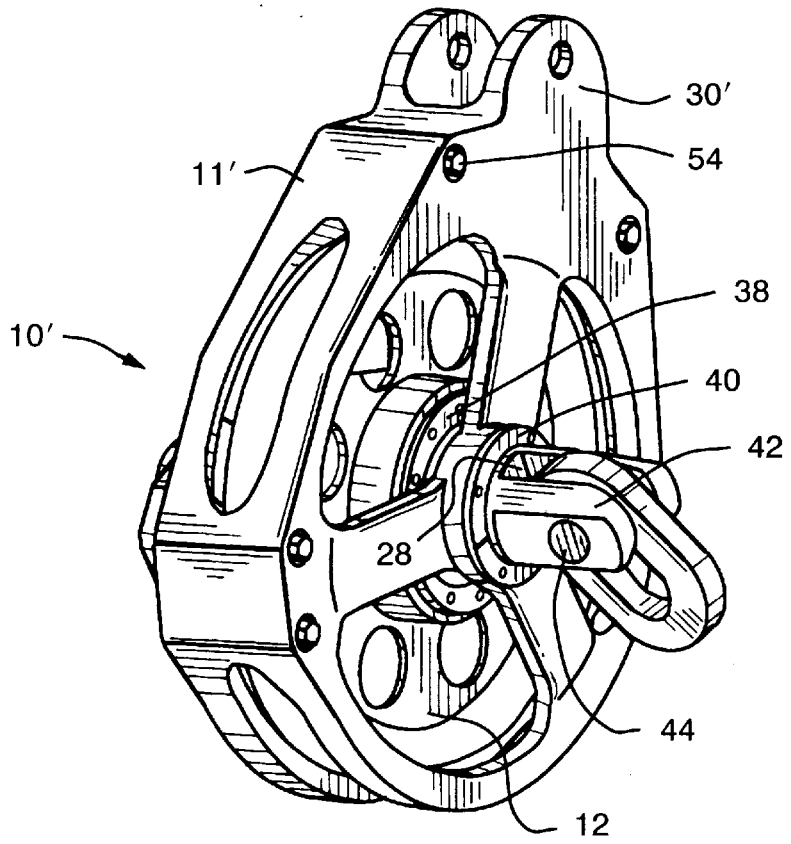
FIG. 4 is a perspective view of a second embodiment of a dump block of the present invention.
Figure 5:
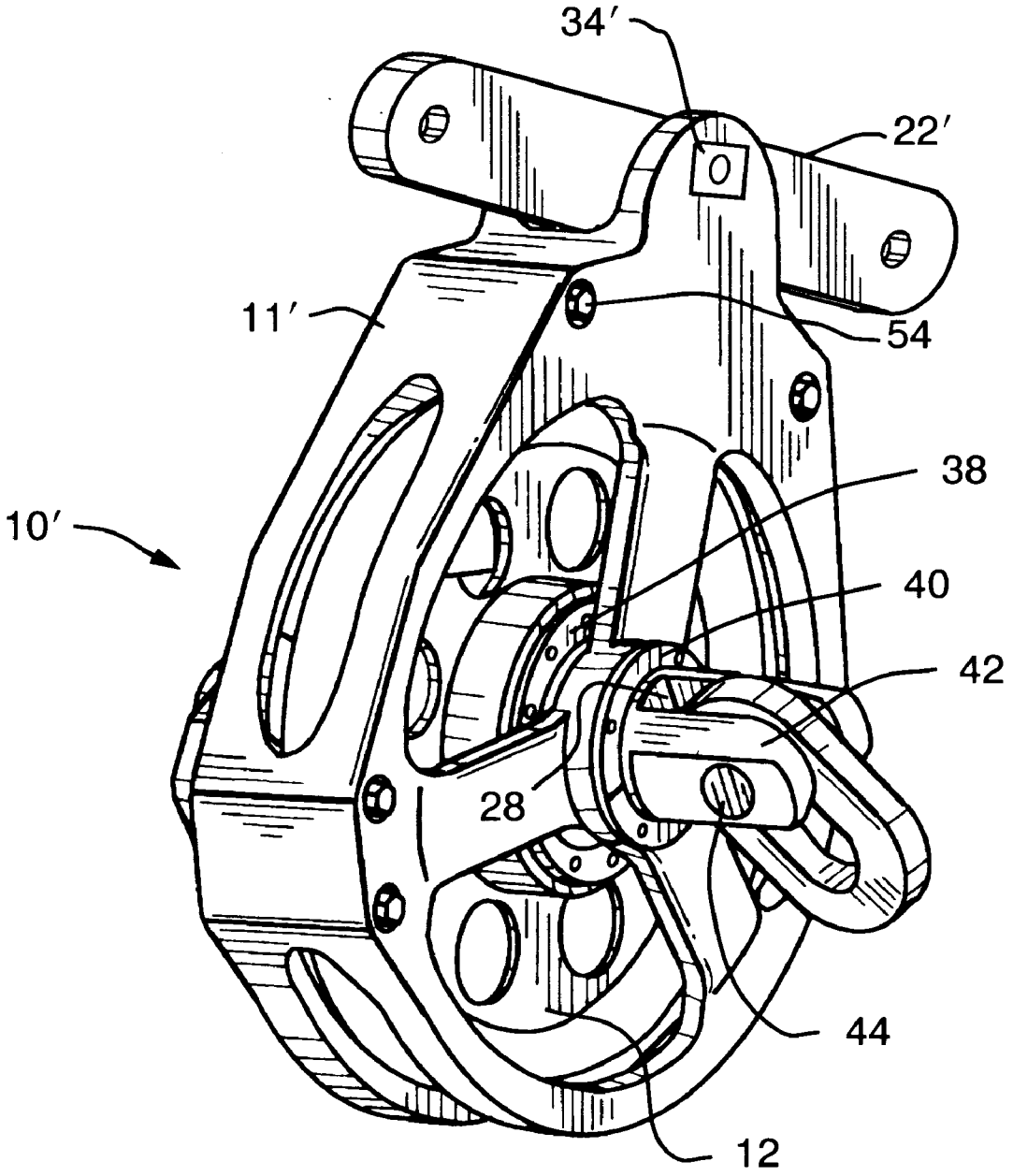
FIG. 5 is a perspective view of the dump block of FIG. 4 shown fastened to an equalizer.

In this construction, the fastener 34 forming the axis of rotation for equalizer 22 and housing 11 is substantially perpendicular to pin 28 forming the axis of rotation for sheave 12. Nevertheless, an alternative dump block 10' (FIGS. 4 and 5), includes a housing 11' provided a clevis 30' which is oriented 90° with respect to the orientation of clevis 30 in FIG. 2. Specifically, the fastener about which clevis 30' rotates is oriented substantially parallel to the pin 28 forming the axis of rotation for sheave 12. Orienting clevis 30' in this manner allows for the attachment of dump block 10' to hoist assemblies of a different configuration than that shown in FIG. 2. Further, as can be appreciated, a wide variety of other attachments could also be used to couple the dump block to the lift lines. Moreover, other connections may be designed to accommodate one, two, four or other number of lift lines.

A support member 42 is provided on each end of pin 28 to effect connection to hoist lines 4. Hoist lines 4 extend upward from opposite side walls of the dragline bucket. The support members 42 are preferably formed as devises on the ends of pin 28, although other connectors could be used. Further, while the hoist lines are preferably attached directly to the ends of pin 28 via fasteners 44, they could instead be attached to an intermediate member(s) which is in turn supported by pin 28.

As discussed above, pin 28 is rotatably coupled relative to sheave 12 and housing 11 via bearings 38, 40. As a result, pin 28 can freely rotate in accordance with the loads and forces transmitted through the hoist lines 4 in order to avoid the creation of twisting moment forces in the dump block or other components of the hoisting assembly. Moreover, any uneven loading of the hoist lines will be accommodated by a natural swinging or canting action of the dump block to further avoid the imposition of moment forces in the components.

Figure 6:
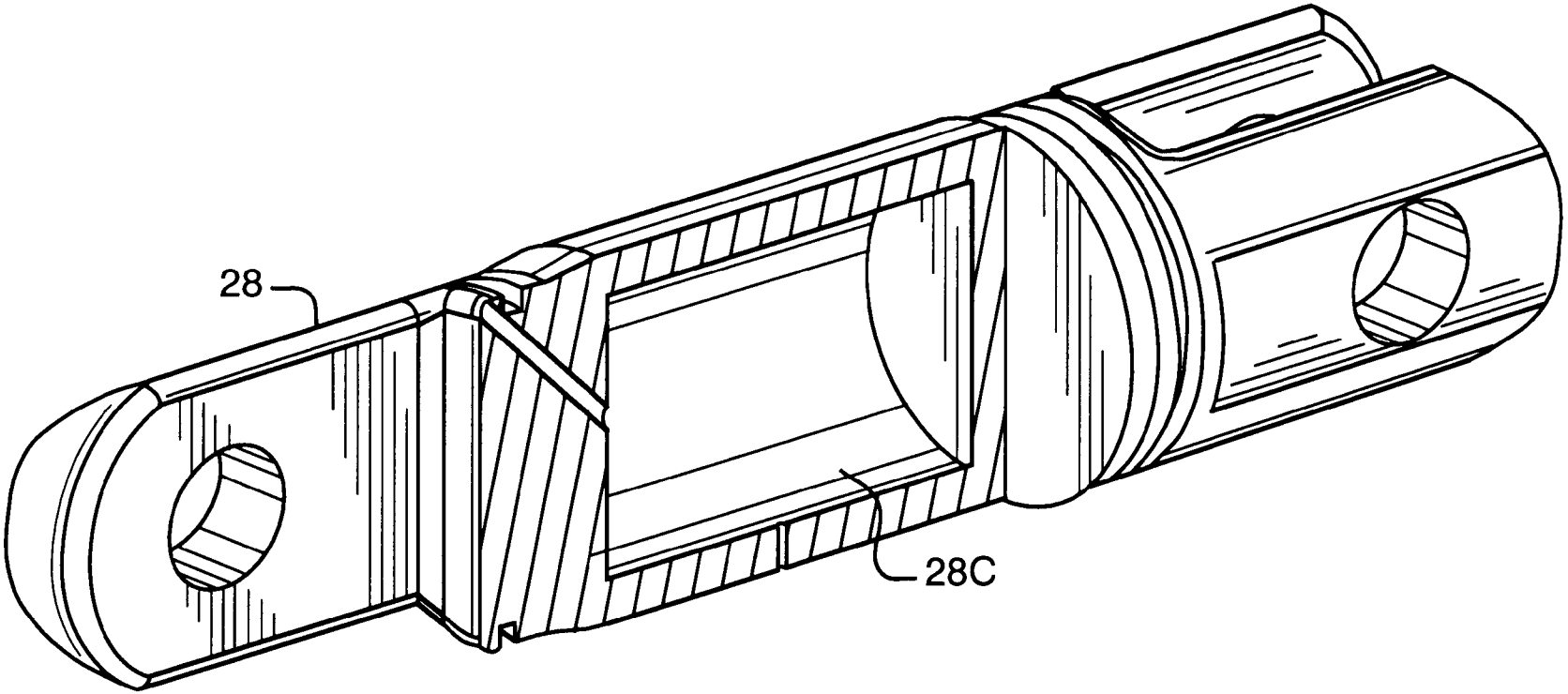
FIG. 6 is a cut-away perspective view of an alternative construction of a central pin.

As an alternative construction, as seen in FIG. 6, pin 28 can be formed as a hollow member which contains lubricant in its central cavity 28C. In this way, the bearings can be regularly lubricated in the manner as taught in U.S. Pat. No. 4,640,496, hereby incorporated by reference. Also, as illustrated, fasteners 34, 36 and 44 typically consist of a shaft 48, head 50, and collar 52. Nonetheless, many other types of fasteners, such as bolts and nuts or shafts with cotter pins, could be used to secure the corresponding components to one another.

Figure 3:
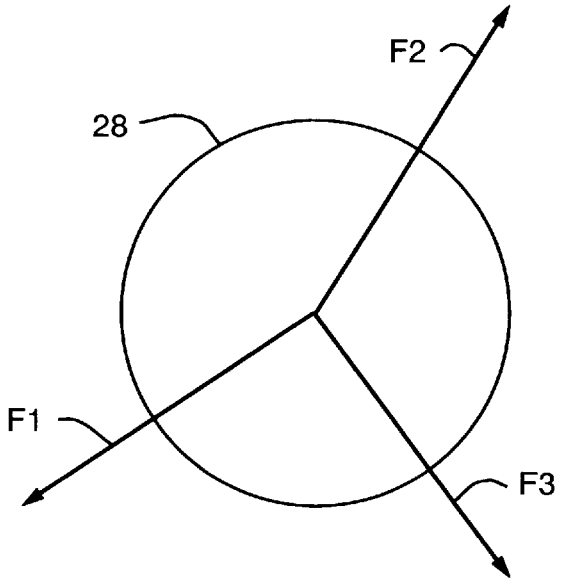
FIG. 3 is a schematic representation of the forces exhibited on the central pin of the integral dump block of the present invention.

In operation, tension is created in dump line 6 through the drag line used to drag the bucket through the ground during a digging operation. As a result of the tension, the dump line moves about the rotating sheave to support the front end of the bucket. This force, depicted schematically as force F1 in FIG. 3, is transferred to central pin 28 via sheave 12. In practice, force F1 is generally nearly double the tension in dump line 6. The tension in lift lines 26 due to lifting or supporting the bucket produces a force F2, which is also transferred to central pin 28 via housing 11. The tension in hoist lines 4, created when lifting or supporting the bucket, produces forces F3 which are transferred to pin 28 via clevises 42. By transferring these forces to a central location, namely the central axis of pin 28, and by permitting free rotation between the sheave, the pin and the housing of the dump block, the moment forces experienced in the prior art are substantially eliminated in the hoist assembly of the present invention. This elimination of moment forces reduces the stresses placed on the components of the present hoisting assembly H and thereby increases their usable life span. By providing the hoisting assembly with a longer usable life, down time for the dragline bucket can be reduced.

Further, the dump block construction of the present invention enables the elimination of a number of parts required in the prior art for operating dragline buckets. Specifically, the present invention no longer needs the upper and lower hoist links, the swivel link, the dump block connecting link and all of their associated pins. Elimination of these parts results in a substantial weight savings in the hoisting assembly. Reduction in the weight of the hoisting assembly H enables the bucket to carry a greater accumulated load of earthen material with each pass, and thus have a greatly enhanced efficiency in the digging operation. Moreover, the sheave 12 and pin 28 can be increased in diameter to provide a longer life for the bearings and dump line, while still obtaining a substantial reduction in weight of the hoisting assembly. Also, by eliminating a number of parts, the hoisting assembly has a more compact construction which, in turn, allows the bucket to be lifted higher and closer to the boom.

In light of the foregoing disclosure of the invention and description of certain preferred embodiments, those who are skilled in this area of technology will readily understand that various modifications and adaptations can be made without departing from the true scope and spirit of the invention. All such modifications and adaptations are intended to be covered by the following claims.

We claim:

1. A dump block for use with a dragline bucket having hoist, dump, and lift lines, comprising:

a sheave for supporting a dump line;

a pin extending through and rotatably supporting the sheave;

a housing extending around at least a portion of the sheave and rotatably coupled to the pin;

a connection member rigidly affixed to the housing to operably connect the housing to at least one lift line; and a support member on each end of the pin to operably connect a hoist line thereto.

2. A dump block in accordance with claim 1 further comprising a bearing housed within the sheave for receiving the pin.

3. A dump block in accordance with claim 2 further comprising a pair of outer bearings disposed to each side of the sheave to couple the housing to the pin.

4. A dump block in accordance with claim 1 further comprising a pair of outer bearings disposed to each side of the sheave to couple the housing to the pin.

5. A dump block in accordance with claim 4 in which said pin includes an internal cavity containing lubricant for lubricating said bearings.

6. A dump block in accordance with claim 1 wherein each support member includes a clevis formed on each end of the pin.

7. A dump block in accordance with claim 1 wherein the connection member includes a clevis formed on an end of the housing.

8. A dump block in accordance with claim 1 wherein the housing is pivotally coupled to the at least one lift line by a fastener in the connection member, and said fastener is oriented substantially perpendicular to said pin.

9. A dump block in accordance with claim 1 wherein the housing is pivotally coupled to the at least one lift line by a fastener in the connection member, and said fastener is oriented substantially parallel to said pin.

10. A dump block for use with a dragline bucket having hoist, dump, and lift lines, comprising:

a sheave for supporting a dump line;

a pin extending through and rotatably supporting the sheave;

at least one first connector for attaching at least one lift line to the pin, the first connector configured to always direct the lift line radially from the pin when loaded;

at least one second connector for attaching a hoist line to the pin.

11. A dump block in accordance with claim 10 wherein said first connector is a housing that encases the sheave, and the pin extends through opposed sides of the housing.

12. A dump block in accordance with claim 11 wherein the housing defines an opening for a fastener that connects the at least one lift line thereto, and said fastener is oriented substantially perpendicular to said pin.

13. A dump block in accordance with claim 11 wherein the housing defines an opening for a fastener that connects the at least one lift line thereto, and said fastener is oriented substantially parallel to said pin.

14. A dump block in accordance with claim 11 further comprising a first bearing disposed within the sheave for receiving the pin, and a second bearing disposed on each side of the housing for receiving the pin.

15. A dump block in accordance with claim 10 wherein said second connector includes a connector formed on each end of the pin.

16. An apparatus for use with a dragline bucket, comprising:

hoist lines attached to the bucket;

at least one lift line for lifting the bucket;

a dump line connected to the bucket and to a drag line for pulling the bucket;

a sheave providing a sole intermediate support for the dump line;

a pin for rotatably supporting the sheave;

a connector connecting the pin to at least one lift line; and a first support member directly connecting a first hoist line on one end of the pin, and a second support member directly connecting a second hoist line on another end of the pin.

17. An apparatus in accordance with claim 16 further comprising:

a plurality of lift lines;

a hoist socket fixed to an end of each lift line;

an equalizer operably connected to the hoist sockets to accommodate different lengths in the lift lines; and a connection member provided on the housing operably connected to the equalizer.

18. An apparatus in accordance with claim 17 wherein the connection member comprises a clevis with aligned apertures, a fastener extending through the apertures of the clevis and an aperture formed in the equalizer to connect the equalizer to the clevis.

19. An apparatus in accordance with claim 17 wherein each support member comprises a clevis with aligned apertures, a fastener extending through the apertures of the clevis to connect the hoist lines to the clevis.

20. An apparatus in accordance with claim 17 further comprising a bearing housed within the sheave for receiving the pin.

21. An apparatus in accordance with claim 17 further comprising a bearing disposed on each side of the housing for receiving the pin.

* * * * *